US009422500B2

(12) United States Patent
Ikuma et al.

(10) Patent No.: US 9,422,500 B2
(45) Date of Patent: Aug. 23, 2016

(54) NOISE REDUCING GREASE COMPOSITION

(75) Inventors: Kyosuke Ikuma, Fujisawa (JP); Mitsuhiro Kakizaki, Fujisawa (JP); Koji Sakakibara, Kariya (JP); Shozo Ikejima, Kariya (JP); Suehiro Okazaki, Kariya (JP); Koji Hisaka, Kariya (JP)

(73) Assignees: KYODO YUSHI CO., LTD., Kanagawa (JP); DENSO CORPORATION, Aichi (JP)

( * ) Notice: Subject to any disclaimer, the term of this patent is extended or adjusted under 35 U.S.C. 154(b) by 47 days.

(21) Appl. No.: 13/201,282

(22) PCT Filed: Feb. 15, 2010

(86) PCT No.: PCT/JP2010/052188
§ 371 (c)(1),
(2), (4) Date: Aug. 12, 2011

(87) PCT Pub. No.: WO2010/093039
PCT Pub. Date: Aug. 19, 2010

(65) Prior Publication Data

US 2011/0294705 A1 Dec. 1, 2011

(30) Foreign Application Priority Data

Feb. 13, 2009 (JP) ..... 2009-031496

(51) Int. Cl.
*C10M 169/02* (2006.01)
*C10M 111/04* (2006.01)
*C10M 107/02* (2006.01)

(52) U.S. Cl.
CPC ..... *C10M 111/04* (2013.01); *C10M 107/02* (2013.01); *C10M 169/02* (2013.01); *C10M 2201/1056* (2013.01); *C10M 2205/0265* (2013.01); *C10M 2205/0285* (2013.01); *C10M 2205/043* (2013.01); *C10M 2207/023* (2013.01); *C10M 2207/1285* (2013.01); *C10M 2209/0845* (2013.01); *C10M 2215/223* (2013.01); *C10M 2219/068* (2013.01); *C10N 2220/021* (2013.01); *C10N 2220/022* (2013.01); *C10N 2220/082* (2013.01); *C10N 2230/76* (2013.01); *C10N 2250/10* (2013.01)

(58) Field of Classification Search
USPC ..... 508/110
See application file for complete search history.

(56) References Cited

U.S. PATENT DOCUMENTS

| | | | | | |
|---|---|---|---|---|---|
| 4,556,496 | A * | 12/1985 | Glova | ..... | 508/405 |
| 5,207,935 | A * | 5/1993 | Waynick | ..... | 508/158 |
| 5,538,653 | A * | 7/1996 | Avery et al. | ..... | 508/229 |
| 5,668,092 | A | 9/1997 | Denton | | |
| 2002/0142920 | A1 | 10/2002 | Sugimori et al. | | |
| 2009/0088353 | A1 * | 4/2009 | Berry et al. | ..... | 508/388 |

FOREIGN PATENT DOCUMENTS

| | | |
|---|---|---|
| CN | 1252364 | 5/2000 |
| CN | 1978599 | 6/2007 |
| JP | 54-18809 | 2/1979 |
| JP | 7-173483 | 7/1995 |
| JP | 11-029762 | 2/1999 |
| JP | 11-315298 | 11/1999 |
| JP | 2000-230188 | 8/2000 |
| JP | 2007-002872 | 1/2007 |

OTHER PUBLICATIONS

Extended European Search Report dated Jul. 26, 2012, issued in corresponding European Application No. 10741316.3-2104.
Database WPI, Week 200803, Thomson Scientific, London, GB AN 2008-A35563, XP002677370 & CN 1978599, (China Petro-Chem Corp), Jun. 13, 2007, 1 page.
International Search Report for PCT/JP2010/052188, mailed Apr. 20, 2010.
Written Opinion for PCT/JP2010/052188, mailed Apr. 20, 2010.
Chinese Office Action issued for Chinese Patent Application No. 201080007575.6, dated Nov. 23, 2012.
National Lubricating Grease Institute, Lubricating Grease Guide, 5 pages, fifth ed., Kansas City, MO, 2006.

* cited by examiner

*Primary Examiner* — Taiwo Oladapo
(74) *Attorney, Agent, or Firm* — Nixon & Vanderhye P.C.

(57) ABSTRACT

The invention provides a grease composition capable of smoothly operating the lubricated parts even under wide-ranging temperature conditions, and at the same time, exhibiting excellent noise reducing effect on the lubricated parts. The grease composition containing a base oil and a thickener is provided, wherein the base oil includes at least one first base oil selected from the group consisting of poly-α-olefins and ethylene-α-olefin oligomers and at least one second base oil selected from the group consisting of polybutene, polyisobutylene, polymethacrylate, and styrene based copolymers, with the first base oil being contained in an amount of 65 mass % or more and the second base oil being contained in an amount of 1 mass % or more and less than 35 mass % based on the total mass of the base oil, the base oil having a kinematic viscosity of 350 to 1400 $mm^2/s$ at 40° C., the first base oil having a kinematic viscosity of 300 to 1200 $mm^2/s$ at 40° C., and the second base oil having a kinematic viscosity of 1500 to 200,000 $mm^2/s$ at 40° C.

5 Claims, No Drawings

NOISE REDUCING GREASE COMPOSITION

This application is the U.S. national phase of International Application No. PCT/JP2010/052188 filed 15 Feb. 2010 which designated the U.S. and claims priority to JP Patent Application No. 2009-31496 filed 13 Feb. 2009, the entire contents of each of which are hereby incorporated by reference.

TECHNICAL FIELD

The present invention relates to a grease composition having excellent noise reduction effect and operability at low temperatures.

BACKGROUND ART

The recent upgrading of cars has requested to enhance the quality of each automotive part. Noise reduction of the automotive parts has become one of the problems to be solved. There is also a demand for improvement of the grease performance to reduce the noise of automotive parts. As for the grease performance, there is another demand for the temperature properties covering a wider range (from high temperatures to low temperatures).

Addition of a polymer, which is a measure taken to reduce noise has achieved the goal to some extent. For example, there is disclosed a grease composition provided with noise reduction performance by adding a ultra-high molecular weight polyolefin powder (Japanese Patent Unexamined Publication (JP Kokai) Hei 07-173483).

However, the base oils and polymers with high viscosities are inferior in fluidity at low temperatures (due to their high pour points), so that the operating temperature region will be limited. Accordingly, both properties may not be satisfied according to the selection of base oils and polymers.

Further, the grease where the polymer powders are added as mentioned above has the drawback of short life because the grease may be hardened upon heating.

SUMMARY OF INVENTION

Technical Problem

An object of the invention is to provide a grease composition capable of smoothly operating the lubricated parts under the wide-ranging temperature conditions.

Another object of the invention is to provide a grease composition having excellent noise reducing effect on the lubricated parts.

It is a further object of the invention to provide a grease composition having excellent noise reduction effect while maintaining satisfactory operability at low temperatures.

It is a still another object of the invention to provide a unit where the above-mentioned grease composition is packed for lubrication, in particular, an air conditioning unit for vehicles.

Solution to Problem

The inventors of the present invention found that when a predetermined amount of a second base oil with a high viscosity is added to a first base oil with a low viscosity, noise reduction of the lubricated parts can be improved, with good operability at low temperatures being maintained. The invention has been thus accomplished based on the above findings.

The invention provides a grease composition and a unit where the grease composition is packed for lubrication, as shown below.

(1) A grease composition comprising a base oil and a thickener, wherein the base oil comprises at least one first base oil selected from the group consisting of poly-α-olefins and ethylene-α-olefin oligomers and at least one second base oil selected from the group consisting of polybutene, polyisobutylene, polymethacrylate, and styrene based copolymers, the content of the first base oil exceeds 65 mass % and the content of the second base oil is 1 mass % or more and less than 35 mass %, with respect to the total mass of the base oil, the base oil has a kinematic viscosity of 350 to 1400 $mm^2/s$ at 40° C., the first base oil has a kinematic viscosity of 300 to 1200 $mm^2/s$ at 40° C. and the second base oil has a kinematic viscosity of 1500 to 200,000 $mm^2/s$ at 40° C.

(2) The noise reducing grease composition described in the above-mentioned item (1), characterized in that the second base oil comprises polybutene.

(3) The noise reducing grease composition described in the above-mentioned item (1) or (2), wherein the thickener comprises silica.

(4) The noise reducing grease composition described in any one of the above-mentioned items (1) to (3), wherein the polybutene has a number-average molecular weight of 600 to 4000.

(5) An air conditioning unit for vehicles, comprising the noise reducing grease composition described in any one of the above-mentioned items (1) to (4).

Advantageous Effects of Invention

The grease composition of the invention is excellent in operability at low temperatures and also excellent in noise reducing effect on the units lubricated with the grease composition, in particular, an air conditioning unit or the like for use in vehicles.

DESCRIPTION OF EMBODIMENTS

The thickener used in the grease composition of the invention is not particularly limited, but any thickeners are available. For example, there can be used soap-based thickeners including Li soap and Li complex soap; urea thickeners including diurea; inorganic thickeners such as organoclay and silica; organic thickeners including PTFE, and the like. Particularly preferred is silica, which is a thickener excellent in noise reduction performance and operability at low temperatures. The silica may preferably have an average particle diameter of 0.1 μm or less, more preferably 0.05 μm or less.

The amount of thickener to be added is not particularly limited so long as a desired consistency can be obtained. Generally, the amount of thickener may be preferably in the range of 3 to 20 mass %, and more preferably 5 to 15 mass %, based on the total mass of the grease composition.

The base oil used for the grease composition according to the invention comprises at least one first base oil selected from the group consisting of poly-α-olefins and ethylene-α-olefin oligomers and at least one second base oil selected from the group consisting of polybutene, polyisobutylene, polymethacrylate, and styrene based copolymers.

The content of the first base oil exceeds 65 mass %, preferably 90 mass % or more, and the content of the second base oil is 1 mass % or more and less than 35 mass %, preferably in the range of 1 to 10 mass %, with respect to the total mass of the base oil.

The base oil has a kinematic viscosity of 350 to 1400 $mm^2/s$, preferably 400 to 600 $mm^2/s$ at 40° C.

The first base oil has a kinematic viscosity of 300 to 1200 $mm^2/s$, preferably 350 to 550 $mm^2/s$ at 40° C.

The second base oil has a kinematic viscosity of 1500 to 200,000 $mm^2/s$, preferably 2000 to 180,000 $mm^2/s$ at 40° C.

Any of the poly-α-olefins and ethylene-α-olefin oligomers that can be used as the first base oil show excellent operability at low temperatures.

Among polybutene, polyisobutylene, polymethacrylate and styrene based copolymers that can be used as the second base oil, polybutene is particularly preferred.

The pressure-viscosity coefficient (α) of the first base oil may preferably be 10 to 20 $GPa^{-1}$, and the pressure-viscosity coefficient (α) of the second base oil may preferably be 25 $GPa^{-1}$ or more.

The second base oil can exhibit excellent noise reduction effect on the ground of high pressure-viscosity coefficient (α). Especially, polybutene can exhibit excellent noise reduction effect because the pressure-viscosity coefficient (α) is as high as about 30 $GPa^{-1}$ (Masayoshi Muraki: Viscosity-pressure properties, Junkatsu, vol. 33, 1 (1988) p. 36).

Preferably, the second base oil, specifically, polybutene may have a number-average molecular weight of 600 to 4000, more preferably 750 to 3000. It is necessary to adjust the amount of the second base oil, particularly polybutene when added because the operability at low temperatures is not satisfactory.

The second base oil is contained in an amount of 1 mass % or more and less than 35 mass %, preferably 1 to 30 mass %, and more preferably 2 to 10 mass %, with respect to the total mass of the base oil.

The base oil used in the invention may further comprise a third base oil other than the above-mentioned first and second base oils. Examples of the third base oil include ester based synthetic oils such as esters, diesters and polyol esters; ether based synthetic oils such as alkyl diphenyl ethers and polypropylene glycol; silicone oils; fluorine-containing oils, and the like. The content of the third base oil may preferably be 5 mass % or less, more preferably 1 mass % or less, with respect to the total mass of the base oil. However, it is most preferable not to add the third base oil.

The kinematic viscosity of the base oil is 350 to 1400 $mm^2/s$, preferably 500 to 1000 $mm^2/s$ at 40° C. With the kinematic viscosity of less than 350 $mm^2/s$, a desired noise reduction effect cannot be obtained. When the kinematic viscosity is more than 1400 $mm^2/s$, the operability at low temperatures tends to worsen.

The grease composition of the invention may further comprise a variety of additives when necessary. For example, antioxidants including phenols and amines; rust preventives including calcium sulfonate; metal corrosion inhibitors such as benzotriazole; oiliness improvers such as castor oil; extreme pressure agents including molybdenum dithiocarbamate and zinc dithiophosphate; solid lubricants including PTFE and MCA, and the like can be used.

As a noise-reduction measure, it is effective to increase the kinematic viscosity by the addition of polymers, as previously mentioned. It is considered that both the noise reduction performance and the operability at low temperatures can be satisfied by adding a small amount of the second base oil such as polybutene or the like which has a high molecular weight and a high pressure-viscosity coefficient (α), with the balance between noise reduction performance and the operability at low temperatures being taken into account.

Examples 1 to 6 and Comparative Examples 1 to 6

Sample greases were prepared in accordance with the formulations shown in Tables 1 and 2.

Two kinds of thickeners, i.e., silica (with an average particle diameter of 0.012 μm) and Li soap (Li-(12OH)St) were used.

With respect to the base oil, poly α-olefins (A and B) and ethylene-α-olefin oligomer were used as the first base oil; and polybutenes (A to C) were used as the second base oil. Their respective kinematic viscosities at 40° C. are shown below. The pressure-viscosity coefficients (α) of polybutene A and polybutene B used as the second base oil are 25 $GPa^{-1}$ or more; while the pressure-viscosity coefficient (α) of polybutene C is less than 25 $GPa^{-1}$.

The content of the base oil in total is obtained by subtracting the total mass of the thickener and other additives from the total mass of the grease composition. The numerical values shown in the columns of the first base oil and the second base oil indicate "mass %" based on the total mass of the both base oils.

First Base Oil poly-α-olefin A (of comparative example): 30.5 $mm^2/s$ poly-α-olefin B (of the invention): poly-α-olefin: 390 $mm^2/s$ ethylene-α-olefin oligomer C (of the invention): 380 $mm^2/s$ Second Base Oil polybutene A (of invention): 160,000 $mm^2/s$ (number-average molecular weight: 2900)

polybutene B (of invention): 2300 $mm^2/s$ (number-average molecular weight: 750)

polybutene C (of comparative example): 205 $mm^2/s$ (number-average molecular weight: 500)

Extreme pressure agent: molybdenum dithiocarbamate (1.5 mass % based on the total mass of grease)

Rust preventive: benzotriazole (0.05 mass % based on the total mass of grease

Antioxidant: phenol (1.0 mass % based on the total mass of grease)

Worked Penetration (JIS K2220 7.)

The worked penetration was adjusted to 280 or 300.

Steel Ball Drop Test (Test for Evaluating the Noise Reduction Effect)

To evaluate the noise reduction effect, each grease was applied to the surface of a steel plate shown below. By dropping the steel ball from a predetermined height, the sound pressure was determined. The sound pressure level of less than 89.6 dB was evaluated as acceptable (marked with "o").

(Test Conditions)

Thickness of applied grease: 0.5 mm

Area of applied grease: 2500 $mm^2$

Size of steel plate: 200 mm×150 mm×1.6 mm

Position of microphone: 200 mm above from steel plate

Original position of steel ball: 100 min above from steel plate

Diameter of steel ball: 12.7 mm

Measuring instrument: 2-channel hand-held FFT analyzer, made by RION Co., Ltd.

Low Temperature Torque Test (JIS K2220 18.)

When the starting torque of less than 380 mN·m and the running torque of less than 320 mN·m under the conditions of −30° C., the grease was evaluated as acceptable (marked with "o").

When compared with the comparative examples, significant improvements in the sound pressure levels (of less than 89.6 dB) and the low temperature torques (i.e., the starting torques of less than 380 mN·m and the running torques of less than 320 mN·m) can be recognized in the grease compositions of Examples 1 and 2 where the poly-α-olefin B with a kinematic viscosity of 390 $mm^2/s$ at 40° C. was used as the first base oil and the polybutene A with a kinematic viscosity of 160,000 $mm^2/s$ at 40° C. was added in an amount of 5 and 7%; the grease composition of Example 3 where the polybutene B with a kinematic viscosity of 2300 $mm^2/s$ at 40° C. was added in an amount of 32%; the grease composition of Example 4 where the worked penetration as in Example 1 was adjusted to 300; the grease composition of Example 5 where the ethylene-α-olefin oligomer C with a kinematic viscosity of 380 $mm^2/s$ at 40° C. was used as the first base oil and the polybutene A with a kinematic viscosity of 160,000 $mm^2/s$ at 40° C. was added in an amount of 5%; and the grease composition of Example 6 where silica used as the thickener in Example 1 was replaced by Li soap.

In Comparative Example 1, the first base oil as used in Example 1 was used alone for the base oil. The results are that the kinematic viscosity of the base oil becomes lower as a whole, thereby degrading the noise reduction performance although the operability at low temperatures is satisfactory, In Comparative Example 2, the amount of the second base oil as used in Example 3 was increased from 32 mass % to 35 mass %. The results are that the operability at low temperatures is inferior although the noise reduction performance is satisfactory.

In Comparative Example 3, the amount of the second base oil as used in Example 1 was increased from 5 mass % to 32 mass % and the kinematic viscosity of the base oil was 1500 $mm^2/s$. The results are that the operability at low temperatures is inferior although the noise reduction performance is satisfactory.

In Comparative Example 4, the poly-α-olefin B with a kinematic viscosity of 390 $mm^2/s$ at 40° C. as used in Comparative Example 3 was replaced by the poly-α-olefin A with a kinematic viscosity of 30.5 $mm^2/s$ at 40° C. as the first base oil. The results are that the kinematic viscosity of the base oil is lowered as a whole, thereby degrading the noise reduction performance although the operability at low temperatures is satisfactory.

Unlike Example 1, Comparative Example 5 used the polybutene C with a kinematic viscosity of 205 $mm^2/s$ at 40° C. in an amount of 15%. The results are that the kinematic viscosity of the base oil is lowered as a whole, thereby degrading the noise reduction performance although the operability at low temperatures is satisfactory.

Unlike Comparative Example 1, Comparative Example 6 used the first base oil of the polybutene C with a kinematic viscosity of 205 $mm^2/s$ at 40° C. alone. The results are that the kinematic viscosity of the base oil is increased as a whole, thereby degrading the operability at low temperatures although the noise reduction performance is satisfactory.

TABLE 1

| Examples | 1 | 2 | 3 | 4 | 5 | 6 |
|---|---|---|---|---|---|---|
| Thickener | silica | silica | silica | silica | silica | Li soap |
| Amount (mass %) | 11.0 | 10.5 | 11.0 | 10.5 | 11.0 | 7.5 |
| First base oil | | | | | | |
| A | | | | | | |
| B | 95.0 | 93.0 | 68.0 | 95.0 | | 95.0 |
| C | | | | | 95.0 | |

TABLE 1-continued

| Examples | 1 | 2 | 3 | 4 | 5 | 6 |
|---|---|---|---|---|---|---|
| Second base oil | | | | | | |
| A | 5.0 | 7.0 | | 5.0 | 5.0 | 5.0 |
| B | | | 32.0 | | | |
| C | | | | | | |
| Kinematic viscosity of base oil | 518 | 576 | 558 | 518 | 525 | 518 |
| Worked penetration | 280 | 280 | 280 | 300 | 280 | 280 |
| Steel ball drop test | 87.2 | 87.4 | 86.8 | 88.6 | 88.7 | 88 |
| Evaluation | ○ | ○ | ○ | ○ | ○ | ○ |
| Low temperature torque test | | | | | | |
| Starting torque | 250 | 240 | 320 | 200 | 230 | 230 |
| Running torque | 200 | 200 | 280 | 180 | 220 | 180 |
| Evaluation | ○ | ○ | ○ | ○ | ○ | ○ |

TABLE 2

| Comparative Examples | 1 | 2 | 3 | 4 | 5 | 6 |
|---|---|---|---|---|---|---|
| Thickener | silica | silica | silica | silica | silica | silica |
| Amount (mass %) | 12.0 | 11.0 | 6.0 | 12.0 | 12.0 | 7.0 |
| First base oil | | | | | | |
| A | | | | 68.0 | | |
| B | 100.0 | 65.0 | 68.0 | | 85.0 | |
| C | | | | | | 100.0 |
| Second base oil | | | | | | |
| A | | | 32.0 | 32.0 | | |
| B | | 35.0 | | | | |
| C | | | | | 15.0 | |
| Kinematic viscosity of base oil | 390 | 583 | 1500 | 360 | 355 | 1240 |
| Worked penetration | 280 | 280 | 280 | 280 | 280 | 280 |
| Steel ball drop test | 89.6 | 86.8 | 85.6 | 89.7 | 90 | 85.5 |
| Evaluation | x | ○ | ○ | x | x | ○ |
| Low temperature torque test | | | | | | |
| Starting torque | 180 | 390 | 480 | 200 | 190 | 1150 |
| Running torque | 160 | 360 | 430 | 170 | 160 | 860 |
| Evaluation | ○ | x | x | ○ | ○ | x |

The invention claimed is:

1. A grease composition comprising a base oil and a thickener, wherein the base oil comprises a first base oil consisting of poly-α-olefins and a second base oil consisting of polybutene, the content of the first base oil exceeds 65 mass % and the content of the second base oil is 1 mass % or more and less than 35 mass %, with respect to the total mass of the base oil, the base oil has a kinematic viscosity of 500 to 1,000 $mm^2/s$ at 40° C., the first base oil has a kinematic viscosity of 350 to 550 $mm^2/s$ at 40° C., the second base oil has a kinematic viscosity of 2,000 to 180,000 $mm^2/s$ at 40° C. and wherein the thickener comprises silica, the grease composition comprises 5 to 15% by mass of the silica as the thickener on the basis of the total mass of the grease composition, and the total mass of the base oil is at least 80% by mass of the grease composition.

2. The grease composition of claim 1, wherein the polybutene has a number-average molecular weight of 600 to 4000.

3. An air conditioning unit for vehicles, comprising the grease composition of claim 1.

4. The noise reducing grease composition of claim 1, wherein the silica has an average particle diameter of 0.1 μm or less.

5. The noise reducing grease composition of claim 1, wherein the silica has an average particle diameter of 0.05 μm or less.

* * * * *